US008814104B2

(12) United States Patent
Yoon

(10) Patent No.: US 8,814,104 B2
(45) Date of Patent: Aug. 26, 2014

(54) TRAIN SENSOR UNIT FOR SENSING RADIO COMMUNICATION BASED TRAIN, TRAIN POSITION SENSING SYSTEM, AND TRAIN POSITION SENSING METHOD OF THE SYSTEM

(75) Inventor: Young Hwan Yoon, Seoul (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 144 days.

(21) Appl. No.: 13/533,888

(22) Filed: Jun. 26, 2012

(65) Prior Publication Data

US 2012/0325979 A1 Dec. 27, 2012

(30) Foreign Application Priority Data

Jun. 27, 2011 (KR) ..... 10-2011-0062549

(51) Int. Cl.
*B61L 25/02* (2006.01)
*B61L 23/04* (2006.01)
*B61L 1/16* (2006.01)

(52) U.S. Cl.
CPC ..... *B61L 23/041* (2013.01); *B61L 23/042* (2013.01); *B61L 25/025* (2013.01); *B61L 1/165* (2013.01); *B61L 1/166* (2013.01)
USPC ..... 246/122 R

(58) Field of Classification Search
CPC ..... B61L 1/14; B61L 1/16; B61L 1/163; B61L 1/164; B61L 1/165; B61L 1/166; B61L 25/02; B61L 25/025; B61L 25/028; B61L 25/04
USPC ..... 246/122 R, 121, 249, 293, 169 S, 247, 246/292; 701/19
See application file for complete search history.

(56) References Cited

U.S. PATENT DOCUMENTS

| | | | | |
|---|---|---|---|---|
| 5,265,831 | A * | 11/1993 | Muller | 246/124 |
| 6,323,785 | B1 * | 11/2001 | Nickell et al. | 340/933 |
| 2001/0022332 | A1 * | 9/2001 | Harland | 246/122 R |
| 2009/0312890 | A1 * | 12/2009 | Evans | 701/2 |
| 2009/0326746 | A1 * | 12/2009 | Mian | 701/19 |

* cited by examiner

*Primary Examiner* — Mark Le
(74) *Attorney, Agent, or Firm* — Lee, Hong, Degerman, Kang & Waimey

(57) ABSTRACT

Provided is a train sensor unit for sensing a radio communication based train to transmit train sensing information to a control unit, which includes a sensor unit, a controller unit, and a communication unit. The sensor unit obtains environmental information about an environment in which the train travels. The controller unit determines whether the train is present, based on the obtained environmental information. The communication unit wirelessly transmits the train sensing information to the control unit if the train is present.

6 Claims, 4 Drawing Sheets

TRAIN SENSOR UNIT FOR SENSING RADIO COMMUNICATION BASED TRAIN, TRAIN POSITION SENSING SYSTEM, AND TRAIN POSITION SENSING METHOD OF THE SYSTEM

CROSS-REFERENCE TO RELATED APPLICATIONS

Pursuant to 35 U.S.C. 119(a), this application claims the benefit of earlier filing date and right of priority to Korean Patent Application No. 10-2011-0062549, filed on Jun. 27, 2011, the contents of which are hereby incorporated by reference herein in their entirety.

BACKGROUND

The present disclosure relates to a sensor unit for sensing a radio communication based train, a train position sensing system, and a train position sensing method of the system, and more particularly, to a sensor unit for sensing a radio communication based train, a train position sensing system, and a train position sensing method of the system, which prevent a train crash and maintain a distance between trains, and are used in information facilities.

Signal control facility technologies in the railway field include various signal device technologies and control system technologies to prevent a train accident, ensure safe driving, and efficiently operate a train.

Typical train position sensing systems require a large volume of track circuits, high costs, and are difficult to repair and maintain. In addition, electric current is applied to an idle track circuit with a train absent, which causes standby power consumption.

In addition, current position information of a train is collected within the train, and a separate sensing device is not provided on a ground, thus destabilizing facilities in the train, and communications between the train and the ground.

SUMMARY

Embodiments provide a train position sensing system, which includes a wireless communication facility and a plurality of sensor units for sensing a radio communication based train, to sense the position of the train at a control unit.

The sensor units can be economically installed, repaired, and maintained, and an installation position thereof can be flexibly changed. In addition, the sensor units have a simple configuration, and are arrayed with a small interval, thereby sensing the position of a train more accurately.

In addition, the control unit recognizes a position of a train, and compares the position with a position recognized within the train, so as to improve reliability of the position recognized within the train.

In one embodiment, a sensor unit for sensing a radio communication based train to transmit train sensing information to a control unit, including: a sensor unit obtaining environmental information about an environment in which the train travels; a controller unit determining whether the train is present, based on the obtained environmental information; and a communication unit wirelessly transmitting the train sensing information to the control unit if the train is present.

In another embodiment, a train position sensing system for sensing a position of a radio communication based train, including: a plurality of sensor units determining whether the train travels on a railway to transmit train sensing information; and a control unit receiving the train sensing information to recognize the position of the train.

In another embodiment, a train position sensing method of a train position sensing system comprising a control unit and at least one sensor unit for sensing a radio communication based train, the method including: obtaining environmental information about an environment around the sensor unit; determining whether the train is present, based on the obtained environmental information; transmitting train sensing information from the sensor unit to the control unit if the train is present; and recognizing a first position of the train, based on the train sensing information.

The details of one or more embodiments are set forth in the accompanying drawings and the description below. Other features will be apparent from the description and drawings, and from the claims.

DETAILED DESCRIPTION OF THE EMBODIMENTS

Terms used in the following description and scopes of claims are not limited to terms that have been in dictionaries, and are used only for explaining specific exemplary embodiments while not limiting the present invention.

Therefore, the description proposed herein is just a preferable example for the purpose of illustrations only, not intended to limit the scope of the invention, so it should be understood that other equivalents and modifications could be made thereto without departing from the spirit and scope of the invention.

According to embodiments, the following effects can be attained.

First, sensor units for sensing a radio communication based train include low cost parts so as to decrease installation and maintenance costs, and installation and modification of the sensor units are facilitated using a wireless method.

Secondly, since the sensor units have a simple configuration, the sensor units can be arrayed with a small interval, and detect a position of a train more accurately.

Thirdly, a train is sensed on a ground so as to address limitations of a method of sensing a train therein, thereby sensing a train accurately and safely.

Figure 1:
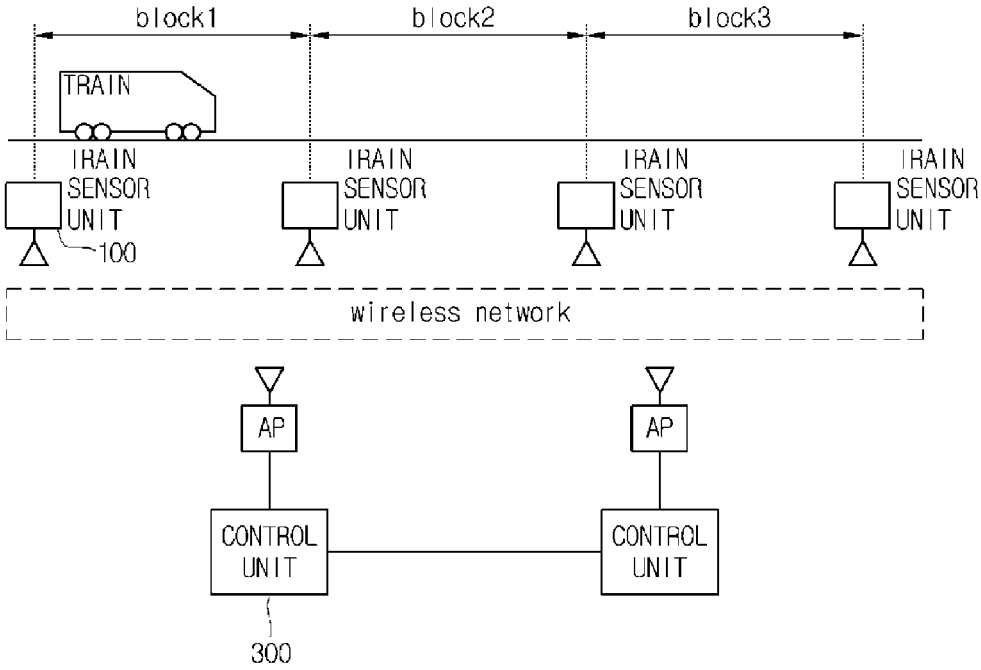
FIG. 1 is a schematic view illustrating a train position sensing system including sensor units for sensing a radio communication based train, according to an embodiment.

FIG. 1 is a schematic view illustrating a train position sensing system including sensor units for sensing a radio communication based train, according to an embodiment.

Referring to FIG. 1, a train position sensing system according to the current embodiment may include a plurality of train sensor units 100 for sensing a radio communication based train, and a control unit 300.

The train sensor units 100 may sense the presence of a train traveling on a railway.

To this end, The train sensor units 100 sense environmental information for determining whether a train travels.

The train sensor units 100 may transmit train sensing information to the control unit 300. The train sensing information may include information for determining whether to sense a train, identification information of The train sensor units 100, and position information of The train sensor units 100.

When one of The train sensor units 100 senses a traveling train, the identification information of the train sensor unit 100 may be transmitted to the control unit 300. Identification information of The train sensor units 100 is used to discriminate The train sensor units 100 from one another, and may include respective identification (ID) numbers of The train sensor units 100.

The control unit 300 receives the identification information of the train sensor unit 100 to detect a position of the train. In particular, the control unit 300 may have the position information of The train sensor units 100, which corresponds to the identification information of The train sensor units 100. When the control unit 300 receives the identification information of the train sensor unit 100, the position of the train may be detected based on the position information of the train sensor unit 100.

As described above, when The train sensor units 100 sense a traveling train, the identification information and the position information may be transmitted to the control unit 300. The control unit 300 may detect a position of a train, based on the identification information and the position information.

The train sensor units 100 may be arrayed with a constant interval at a side of a railway. According to an embodiment, a distance between The train sensor units 100 may be smaller than the length of a train. In this case, the control unit 300 receives train sensing information from The train sensor units 100 disposed at a plurality of positions on a railway, so as to accurately detect sections in which the train is located. That is, in a section where trains are concentrated, or a section where a bottleneck occurs, the distance between The train sensor units 100 may be decreased to accurately detect a position of a train.

The train sensor units 100 may be classified into a first sensor unit group and a second sensor unit group. The first sensor unit group may be controlled by a first control unit to be described later, and the second sensor unit group may be controlled by a second control unit to be described later. Thus, the number of sensor units controlled by one control unit is decreased, thereby controlling sensor units more efficiently.

The train sensor units 100 may communicate with the control unit 300 through a wireless communication network. According to an embodiment, the wireless communication network may be a network for a communication-based train control (CBTC) system.

The control unit 300 may detect a position of a train, based on identification and position information received from The train sensor units 100 through the wireless communication network.

The control unit 300 may include the first and second control units.

Each of the first and second control units may control a plurality of The train sensor units 100.

The first control unit may receive the identification and position information from the first sensor unit group, and the second control unit may receive the identification and position information from the second sensor unit group.

The control unit 300 may detect a position of a train, based on identification and position information received by the first and second control units.

As such, according to the current embodiment, the position of a detected train is used to determine the distance between the detected train and another train, thereby preventing a train crash.

As described above, a train position sensing system including sensor units, and a train position sensing method use a low cost module so as to decrease installation and maintenance costs, and installation and modification of sensor units are facilitated using a wireless method.

In addition, since the sensor units have a simple configuration, the sensor units can be arrayed with a small interval, and detect a position of a train more accurately.

In addition, a train is sensed on a ground so as to address limitations of a method of sensing a train therein, thereby sensing a train accurately and safely.

Figure 2:
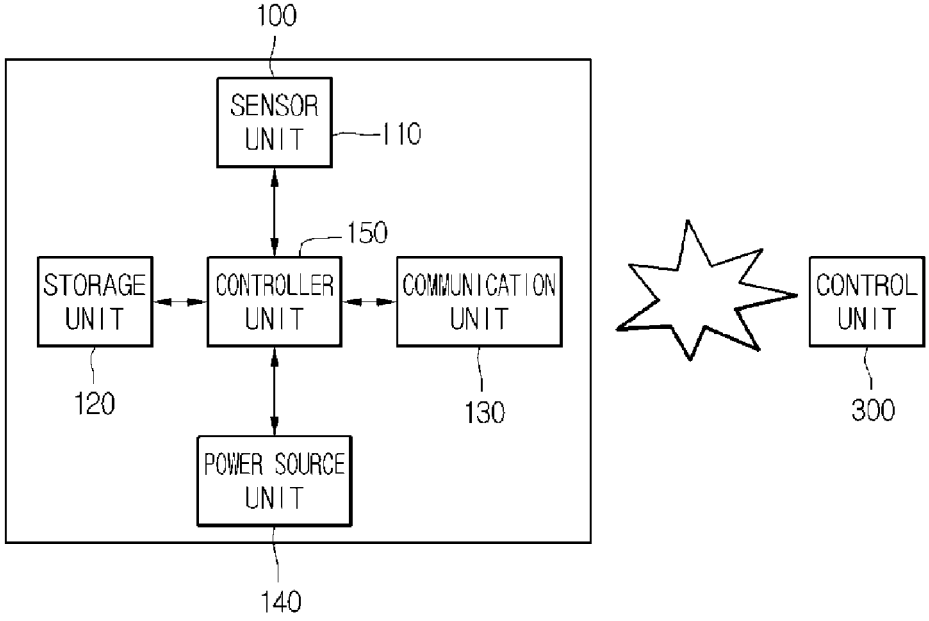
FIG. 2 is a block diagram illustrating the sensor unit of FIG. 1.

FIG. 2 is a block diagram illustrating the train sensor unit 100.

The train sensor unit 100 may include a sensor unit 110, a storage unit 120, a communication unit 130, a power source unit 140, and a controller unit 150.

The sensor unit 110 senses a change caused by a difference between when a train travels on a railway and when a train does not travel on a railway, to thereby sense the presence of the train. That is, the sensor unit 110 may obtain environmental information about a change caused by the presence of a train, and transmit the environmental information to the controller unit 150.

The sensor unit 110 may include one of a sound sensor, a vibration sensor, an infrared sensor, an ultrasound sensor, and a vision sensor.

The controller unit 150 may sense whether a train is sensed, based on sensing information received from the sensor unit 110. According to an embodiment, when the sensor unit 110 includes a sound sensor, the sound sensor may measure a noise made by a train passing by the sound sensor. If the measured sound is equal to or greater than a reference value, the controller unit 150 may determine that the train passes by the sound sensor. According to an embodiment, when the sensor unit 110 includes a vibration sensor, the vibration sensor may measure a vibration made by a train passing by the vibration sensor. If the measured vibration is equal to or greater than a reference value, the controller unit 150 may determine that the train passes by the vibration sensor.

The sensor unit 110 may include at least one of the above described sensors. Due to a malfunction or other circumferential changes, one sensor may fail to accurately sense whether a train passes by the sensor. Thus, the sensor unit 110 may include two or more different type sensors, or two or more same type sensors.

The storage unit 120 stores the identification information for discriminating The train sensor units 100 from one another. When the control unit 300 receives various types of information from the train sensor unit 100, the control unit 300 also receives the identification information of the train sensor unit 100 so as to identify the train sensor unit 100.

The storage unit 120 further stores the position information of The train sensor units 100 to recognize the positions of The train sensor units 100 along a railway. The position information of The train sensor units 100 may corresponds to the identification information of The train sensor units 100, so that the control unit 300 can recognize the position information by receiving only the identification information.

The communication unit 130 may transmit the identification and position information of a corresponding one of The train sensor units 100, to the control unit 300 through the wireless communication network.

To this end, the communication unit 130 may includes a device such as an antenna, but is not limited thereto, and thus, may include one of various types of short range communication modules and long range communication modules.

The train sensor units 100 transmit respective train sensing information through the communication unit 130, so as to share the train sensing information. The train sensing information may include information for determining whether to sense a train, and the identification and position information of The train sensor units 100.

The power source unit 140 may supply power for normally operating the train sensor unit 100.

The power source unit 140 may be a wireless power supply device such as a battery. In this case, mobility of the train sensor unit 100 can be improved, and installation and maintenance costs thereof can be saved.

The controller unit 150 may control the overall operation of the train sensor unit 100.

The controller unit 150 may determine whether a train is sensed, based on environmental information received from the sensor unit 110.

If the controller unit 150 determines that a train is sensed, the controller unit 150 may control train sensing information and the identification information of the train sensor unit 100 to be transmitted to the control unit 300 through the communication unit 130.

Figure 3:
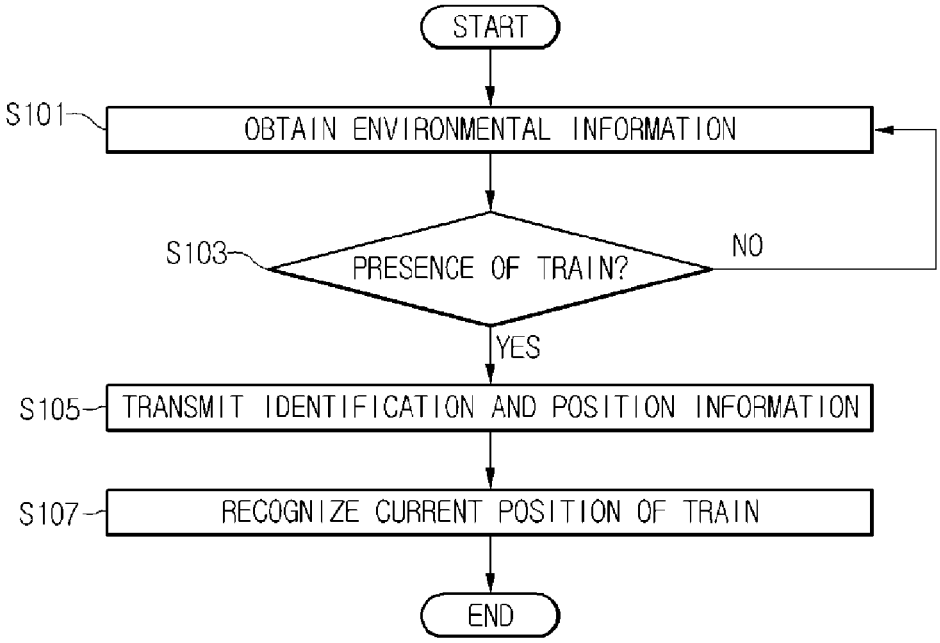
FIG. 3 is a flowchart illustrating a train position sensing method according to a first embodiment.

FIG. 3 is a flowchart illustrating a train position sensing method according to a first embodiment.

A configuration of the train sensor unit 100 is referred to in the above description with reference to FIG. 2.

In operation S101, the train sensor unit 100 obtains environmental information. The train sensor unit 100 may obtain, through the sensor unit 110, environmental information about a change caused by the presence of a train.

In operation S103, the train sensor unit 100 determines whether a train is present, based on the obtained environmental information. The sensor unit 110 may transmit the obtained environmental information to the controller unit 150, and the controller unit 150 may determine whether a train is present, based on the obtained environmental information.

If a train is present, the train sensor unit 100 transmits the identification and position information to the control unit 300 in operation S105.

In operation S107, the control unit 300 recognizes a current position of the train, based on the identification and position information.

If a train is not present, the train sensor unit 100 obtains environmental information again in operation S101.

According to the current embodiment, a current position of a train can be accurately detected using The train sensor units 100 so as to prevent a train crash, and efficiently adjust the distance between trains.

Figure 4:
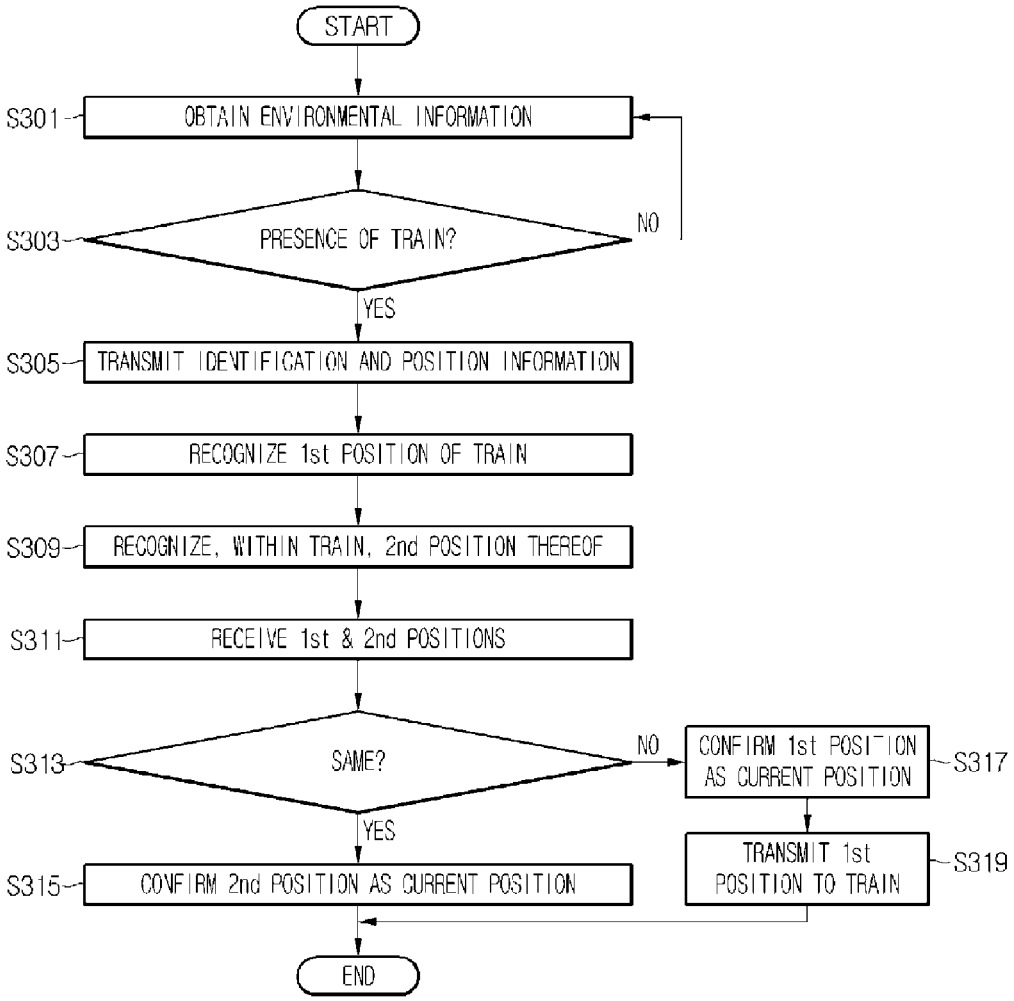
FIG. 4 is a flowchart illustrating a train position sensing method according to a second embodiment.

FIG. 4 is a flowchart illustrating a train position sensing method according to a second embodiment.

In operation S301, the train sensor unit 100 obtains environmental information.

In operation S303, the train sensor unit 100 determines whether a train is present, based on the obtained environmental information.

If a train is present, the train sensor unit 100 transmits the identification and position information to the control unit 300 in operation S305.

In operation S307, the control unit 300 recognizes a first position as a current position of the train, based on the identification and position information.

In operation S309, within the train that travels, a second position thereof is recognized using both a balise installed on a railway and an antenna installed on the train.

The balise is a device installed on a railway to transmit position information of a train to the train.

In operation S311, the control unit 300 receives the first position recognized by the train sensor unit 100, and the second position recognized within the train.

In operation S313, the control unit 300 compares the first position with the second position. If the first position and the second position are the same, the control unit 300 confirms the second position as the current position of the train in operation S315. In this case, the current position of the train is accurately recognized is notified within the train.

If the first position and the second position are different, the control unit 300 confirms the first position as the current position of the train in operation S317. In this case, the current position of the train is inaccurately recognized is notified within the train. That is, if the first position and the second position are different, the train may not be disposed at the second position recognized within the train.

In operation S319, the control unit 300 transmits the confirmed first position to the antenna installed on the train. Thus, it is recognized within the train that the second position is not the current position, and the first position is the current position.

As such, according to the current embodiment, since a current position of a train is recognized at both the train and the control unit 300, it can be notified that the current position recognized within the train is wrong. Thus, the current position of the train can be accurately recognized to prevent a train crash.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A train sensor unit comprising:

a sensor unit obtaining environmental information about an environment in which a train travels, wherein the sensor unit comprises a sound sensor and a vibration sensor;

a controller unit determining whether the train is detected, based on the obtained environmental information; and a communication unit wirelessly transmitting train sensing information to a control unit if the train is detected, wherein the train sensing information comprises identification information of the train sensor unit, position information of the train sensor unit and information on whether the train is detected, wherein the train sensor unit shares the train sensing information with another train sensor unit through the communication unit, and wherein the controller unit determines that the train is present if a noise measured by the sound sensor is equal to or greater than a reference value and a vibration measured by the vibration sensor is equal to or greater than a reference value.

2. The train sensor unit according to claim 1, further comprising a storage unit that stores the identification information and the position information of the train sensor unit.

3. The train sensor unit according to claim 1, further comprising a power source unit that wirelessly supplies power to the train sensor unit.

4. A train position sensing system for sensing a position of a radio communication based train, comprising:

a plurality of train sensor units determining whether the train travels on a railway to transmit train sensing information, each of the plurality of train sensor units comprising a sensor unit obtaining environmental information about an environment in which the train travels, wherein the sensor unit comprises a sound sensor and a vibration sensor; and a control unit receiving the train sensing information to recognize the position of the train, wherein the train sensing information comprises identification information of the train sensor unit, position information of the train sensor unit and information on whether the train is detected, wherein each of the plurality of train sensor units shares the train sensing information with another train sensor unit through a communication unit of the train sensor unit, and wherein a controller unit of at least one train sensor unit of the plurality of train sensor units determines that the train is present if a noise measured by the sound sensor of the at least one train sensor unit is equal to or greater than a reference value and a vibration measured by the vibration sensor of the at least one train sensor unit is equal to or greater than a reference value.

5. The train position sensing system according to claim 4, wherein each of the plurality of train sensor units comprises:

the controller unit determining whether the train is detected, based on the obtained environmental information; and the communication unit wirelessly transmitting the train sensing information to the control unit if the train is detected.

6. The train position sensing system according to claim 4, wherein the control unit comprises a first control unit and a second control unit, the train sensor units comprise a first sensor unit group and a second train sensor unit group, the first control unit receives first train sensing information from the first train sensor unit group, the second control unit receives second train sensing information from the second train sensor unit group, and the first control unit and the second control unit share the first train sensing information and the second train sensing information.

* * * * *